US007332129B2

(12) United States Patent
Robole et al.

(10) Patent No.: US 7,332,129 B2
(45) Date of Patent: Feb. 19, 2008

(54) SAMPLE PROCESSING DEVICE HAVING PROCESS CHAMBERS WITH BYPASS SLOTS

(75) Inventors: Barry W. Robole, Woodville, WI (US); William Bedingham, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 776 days.

(21) Appl. No.: 10/339,447

(22) Filed: Jan. 9, 2003

(65) Prior Publication Data

US 2004/0137634 A1 Jul. 15, 2004

(51) Int. Cl.
*B01L 3/00* (2006.01)

(52) U.S. Cl. ..... 422/102; 422/68.1; 422/72; 422/99; 422/100; 422/102; 436/45; 436/177; 436/180

(58) Field of Classification Search ..... 422/68.1, 422/72, 99, 102, 100; 436/45, 180, 177
See application file for complete search history.

(56) References Cited

U.S. PATENT DOCUMENTS

| | | | |
|---|---|---|---|
| 3,555,284 | A | 1/1971 | Anderson |
| 3,795,451 | A | 3/1974 | Mailen |
| 3,798,459 | A | 3/1974 | Anderson et al. |
| 3,873,217 | A | 3/1975 | Anderson et al. |
| 5,942,443 | A | 8/1999 | Parce et al. |
| 6,013,513 | A | 1/2000 | Reber et al. |
| 6,030,581 | A | 2/2000 | Virtanen |
| 6,046,056 | A | 4/2000 | Parce et al. |
| 6,063,589 | A | 5/2000 | Kellogg et al. |
| 6,143,248 | A | 11/2000 | Kellogg et al. |
| 6,267,858 | B1 | 7/2001 | Parce et al. |
| 6,319,469 | B1 | 11/2001 | Mian et al. |
| 6,558,944 | B1 | 5/2003 | Parce et al. |
| 6,558,960 | B1 | 5/2003 | Parce et al. |
| 6,717,136 | B2 | 4/2004 | Andersson et al. |
| 6,812,456 | B2 * | 11/2004 | Andersson et al. ..... 250/288 |
| 2002/0001848 | A1 | 1/2002 | Bedingham et al. |
| 2002/0047003 | A1 | 4/2002 | Bedingham et al. |
| 2002/0048533 | A1 | 4/2002 | Harms et al. |
| 2002/0064885 | A1 | 5/2002 | Bedingham et al. |
| 2002/0106786 | A1 | 8/2002 | Carvalho et al. |
| 2003/0066957 | A1 | 4/2003 | Andersson et al. |

FOREIGN PATENT DOCUMENTS

| | | |
|---|---|---|
| EP | 0 169 306 B1 | 1/1986 |
| EP | 0 693 560 A2 | 1/1996 |
| EP | 0 693 560 A3 | 1/1996 |
| WO | WO 96/41864 A1 | 12/1996 |
| WO | WO 97/21090 A1 | 6/1997 |
| WO | WO 98/07019 A1 | 2/1998 |
| WO | WO 98/49340 A1 | 11/1998 |
| WO | WO 99/09394 A1 | 2/1999 |

(Continued)

*Primary Examiner*—Jill Warden
*Assistant Examiner*—Dwayne K. Handy
(74) *Attorney, Agent, or Firm*—Kevin W. Raasch

(57) ABSTRACT

Sample processing devices including process chambers having bypass slots and methods of using the same are disclosed. The bypass slots are formed in the sidewalls of the process chambers and are in fluid communication with distribution channels used to deliver fluid sample materials to the process chambers.

20 Claims, 5 Drawing Sheets

FOREIGN PATENT DOCUMENTS

| | | | |
|---|---|---|---|
| WO | WO 99/55827 | A1 | 11/1999 |
| WO | WO 99/58245 | A1 | 11/1999 |
| WO | WO 99/67639 | A1 | 12/1999 |
| WO | WO 00/05582 | A2 | 2/2000 |
| WO | WO 00/40750 | A1 | 7/2000 |
| WO | WO 00/50172 | A1 | 8/2000 |
| WO | WO 00/50642 | A1 | 8/2000 |
| WO | WO 00/69560 | A1 | 11/2000 |
| WO | WO 00/78455 | A1 | 12/2000 |
| WO | WO 00/79285 | A2 | 12/2000 |
| WO | WO 02/075775 | A1 | 9/2002 |

* cited by examiner

SAMPLE PROCESSING DEVICE HAVING PROCESS CHAMBERS WITH BYPASS SLOTS

BACKGROUND

Many different chemical, biochemical, and other reactions are sensitive to temperature variations. Examples of thermal processes in the area of genetic amplification include, but are not limited to, Polymerase Chain Reaction (PCR), Sanger sequencing, etc. The reactions may be enhanced or inhibited based on the temperatures of the materials involved. Although it may be possible to process samples individually and obtain accurate sample-to-sample results, individual processing can be time-consuming and expensive.

A variety of sample processing devices have been developed to assist in the reactions described above. A problem common to many of such devices is that it is desirable to seal the chambers or wells in which the reactions occur to prevent, e.g., contamination of the reaction before, during, and after it is completed.

Yet another problem that may be experienced in many of these approaches is that the volume of sample material may be limited and/or the cost of the reagents to be used in connection with the sample materials may also be limited and/or expensive. As a result, there is a desire to use small volumes of sample materials and associated reagents. When using small volumes of these materials, however, additional problems related to the loss of sample material and/or reagent volume, etc., may be experienced as the sample materials are transferred between devices.

One such problem may be the loss of fluid sample materials that are forced back into the distribution channels used to deliver the sample materials to the process chambers when a device is inserted into the process chamber. The sample materials forced back into the distribution channels may not be available for further processing, thereby decreasing the amount of available sample materials.

SUMMARY OF THE INVENTION

The present invention provides sample processing devices including process chambers having bypass slots and methods of using the same. The bypass slots are formed in the sidewalls of the process chambers and are in fluid communication with distribution channels used to deliver fluid sample materials to the process chambers.

The bypass slots may preferably reduce or prevent the movement of fluid sample materials from the process chambers back into the distribution channels used to deliver the sample materials to the process chambers during insertion of implements into the process chambers. The bypass slots may accomplish that function by relieving pressure and/or providing fluid paths for escape of air from the process chambers.

The process chambers and bypass slots are preferably designed such that the fluids carrying the sample materials do not wet out the bypass slot after the process chambers have been loaded with the fluid sample materials.

Furthermore, if the implement to be inserted into the process chamber is a capillary electrode (used for electrophoresis), it may be preferred that the process chamber and bypass slot be sized to ensure that the fluid sample materials completely surround the capillary electrode and wet out the metal electrode on the outside surface of the capillary electrode upon its insertion into the process chamber.

In one aspect, the present invention provides a sample processing device including a body having a first major side and an opposing second major side; a plurality of process chambers located within the body, each of the process chambers including a primary void extending between the first major side and the second major side of the body; a distribution channel entering each process chamber of the plurality of process chambers, wherein the distribution channel enters the process chamber proximate the first major side of the body; and a bypass slot formed in a sidewall of each of the process chambers, the bypass slot extending between the first major side and the second major side of the body, wherein the bypass slot opens into the distribution channel proximate the first major side of the body at a location distal from the primary void of the process chamber.

In another aspect, the present invention provides a sample processing device including a body having a first major side and an opposing second major side; a plurality of process chambers located within the body, each of the process chambers including a primary void extending between the first major side and the second major side of the body; a distribution channel entering each process chamber of the plurality of process chambers, wherein the distribution channel enters the process chamber proximate the first major side of the body; and a bypass slot formed in a sidewall of each of the process chambers, the bypass slot extending between the first major side and the second major side of the body, wherein the bypass slot opens into the distribution channel proximate the first major side of the body at a location distal from the primary void of the process chamber; wherein the bypass slot has a cross-sectional area measured in a plane orthogonal to a longitudinal axis of the process chamber, and wherein the cross-sectional area of the bypass slot is at a maximum where the bypass slot opens into the distribution channel, and wherein the bypass slot has a termination point distal from the first major side of the body, and further wherein the termination point of the bypass slot is spaced from the second major side of the body.

In another aspect, the present invention provides methods of processing sample materials located within a process chamber, the method including providing a sample processing device according to the present invention; loading fluid sample material into at least one process chamber of the plurality of process chambers in the sample processing device; and inserting an implement into the at least one process chamber loaded with fluid sample material.

These and other features and advantages of the invention may be described below with respect to various illustrative embodiments of the invention.

DETAILED DESCRIPTION OF ILLUSTRATIVE EMBODIMENTS OF THE INVENTION

Figure 1:
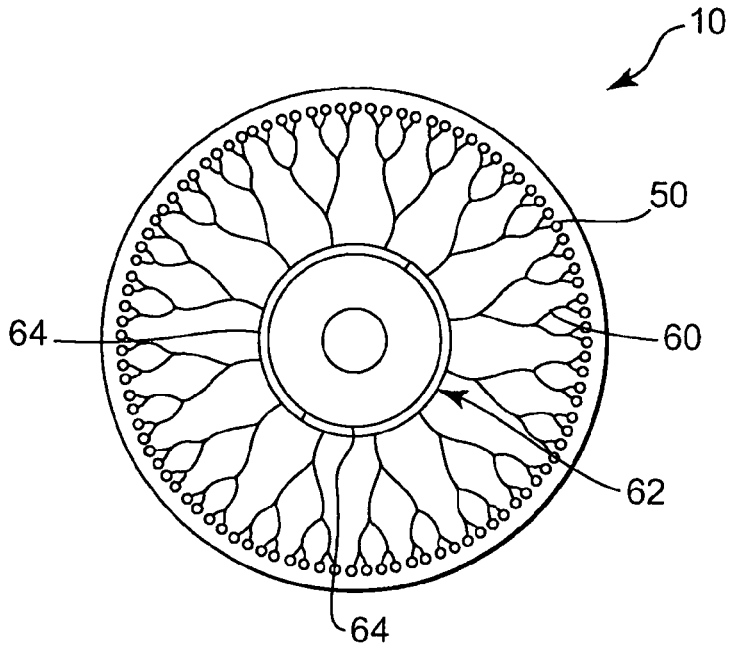
FIG. 1 is a top plan view of one sample processing device according to the present invention.

The present invention provides a sample processing device that can be used in methods that involve thermal processing, e.g., sensitive chemical processes such as PCR amplification, ligase chain reaction (LCR), self-sustaining sequence replication, enzyme kinetic studies, homogeneous ligand binding assays, and more complex biochemical or other processes that require precise thermal control and/or rapid thermal variations.

Although construction of a variety of illustrative embodiments of devices are described below, sample processing devices according to the principles of the present invention may be manufactured according to the principles described in U.S. Provisional Patent Application Ser. No. 60/214,508 filed on Jun. 28, 2000 and titled THERMAL PROCESSING DEVICES AND METHODS; U.S. Provisional Patent Application Ser. No. 60/214,642 filed on Jun. 28, 2000 and titled SAMPLE PROCESSING DEVICES, SYSTEMS AND METHODS; U.S. Provisional Patent Application Ser. No. 60/237,072 filed on Oct. 2, 2000 and titled SAMPLE PROCESSING DEVICES, SYSTEMS AND METHODS; and U.S. Patent Application Publication No. US 2002/0047003 A1 filed on Jun. 28, 2001 and titled ENHANCED SAMPLE PROCESSING DEVICES, SYSTEMS AND METHODS Other potential device constructions maybe found in, e.g., U.S. Pat. No. 6,627,159 issued on Sep. 20, 2003 and titled CENTRIFUGAL FILLING OF SAMPLE PROCESSING DEVICES and U.S. Provisional Patent Application Ser. No. 60/260,063 filed on Jan. 6,2001 and titled SAMPLE PROCESSIING DEVICES, SYSTEMS AND METHODS , U.S. Patent Application Publication No. US 2002/0047003 A1 filed on Jun. 28, 2001 and entitled ENHANCED SAMPLE PROCESSING DEVICES SYSTEMS AND METHODS, U.S. Patent Application Publication No. 2002/0064885 A1 filed on Jun. 28, 2001 and entitled SAMPLE PROCESSING DEVICES, and U.S. Patent Application Publication No. US 2002/0048533 A1 filed Jun. 28, 2001 and entitled SAMPLE PROCESSING DEVICES AND CARRIERS, as well as U.S. Patent Application Publication No. US2003/0118804 A1 , filed on Dec. 19, 2002 and titled SAMPLE PROCESSING DEVICE WITH RESEALABLE PROCESS CHAMBER.

Although relative positional terms such as "top" and "bottom" may be used in connection with the present invention, it should be understood that those terms are used in their relative sense only. For example, when used in connection with the devices of the present invention, "top" and "bottom" are used to signify opposing sides of the devices. In actual use, elements described as "top" or "bottom" may be found in any orientation or location and should not be considered as limiting the methods, systems, and devices to any particular orientation or location. For example, the top surface of the device may actually be located below the bottom surface of the device in use (although it would still be found on the opposite side of the device from the bottom surface).

Also, although the term "process chambers" is used to describe the chambers that include bypass slots in accordance with the present invention, it should be understood that processing (e.g., thermal processing) may or may not occur with the process chambers. In some instances, the process chambers may be merely repositories for sample material that are designed to admit implements for removal of further processing of the sample materials contained therein.

Figure 2:
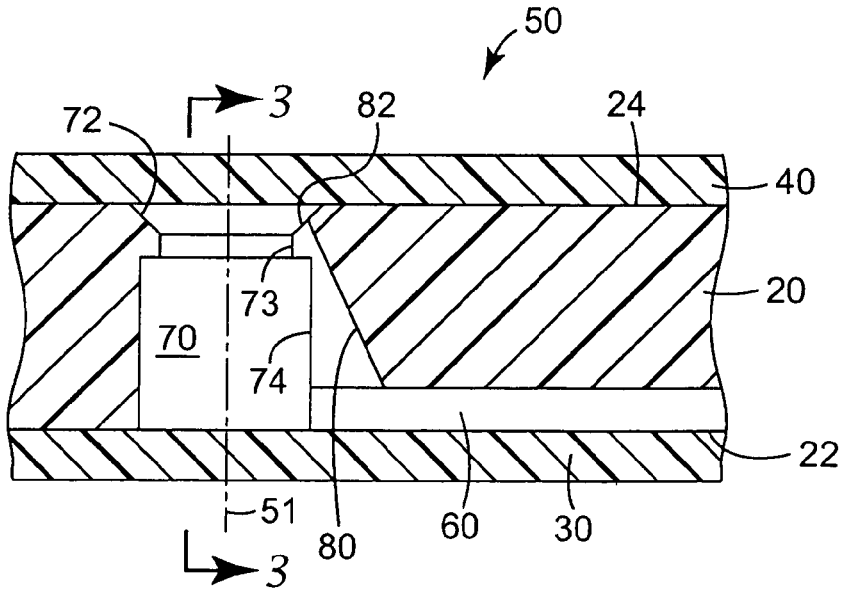
FIG. 2 is an enlarged cross-sectional view of a process chamber in the sample processing device of FIG. 1.
Figure 3:
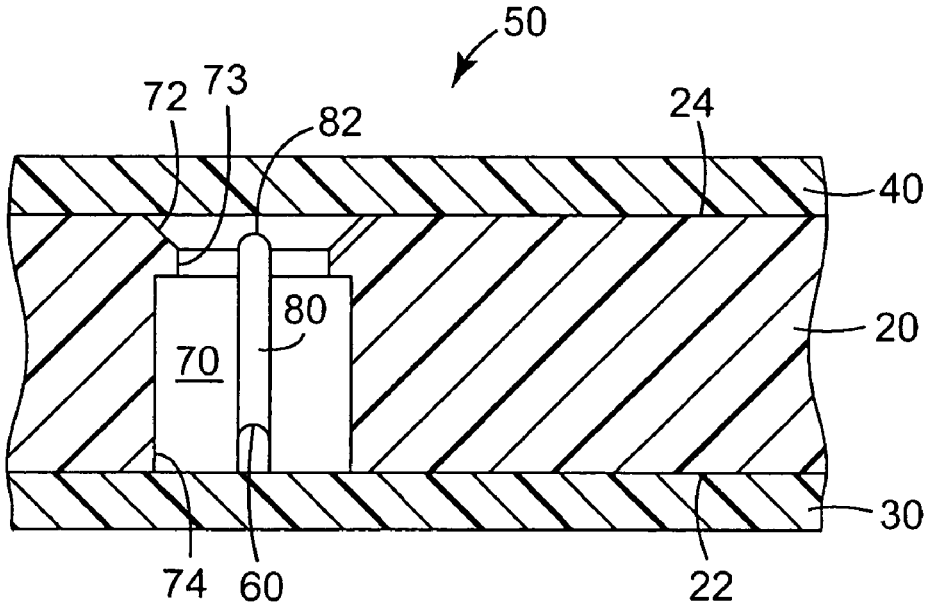
FIG. 3 is a cross-sectional view of the process chamber of FIG. 2 taken along line 3-3 in FIG. 2.

One illustrative device manufactured according to the principles of the present invention is depicted in FIGS. 1-3. The device 10 may be in the shape of a circular disc as illustrated in FIG. 1, although any other shape could be used. For Example, the sample processing devices of the present invention may be provided in a rectangular format compatible with the footprint of convention microtiter plates.

The depicted device 10 includes a plurality of process chambers 50, each of which defines a volume for containing a sample and any other materials that are to be processed with the sample. The illustrated device 10 includes ninety-six process chambers 50, although it will be understood that the exact number of process chambers provided in connection with a device manufactured according to the present invention may be greater than or less than ninety-six, as desired.

Furthermore, although the process chambers 50 are depicted as arranged in a circular array, they may be provided on any sample processing device of the present invention in any configuration. For example, the process chambers 50 may be provided in a rectilinear array compatible with conventional microtiter plate processing equipment. Some examples of sample processing devices with such a design are described in, e.g., U.S. Patent Application Publication No. US 2002/0001848 A1, filed on Apr. 18, 2001 and titled MULTI-FORMAT SAMPLE PROCESSING DEVICES, METHODS AND SYSTEMS.

The device 10 of FIGS. 1-3 is a multi-layered composite structure including a body 20 including a first major side 22 and a second major side 24. A first layer 30 is attached to the first major side 22 of the body 20 and a second layer 40 is attached to the second major side 24 of the body 20. It is preferred that the first layer 30 and the second layer 40 be attached or bonded to their respective major side on body 20 with sufficient strength to resist any expansive forces that may develop within the process chambers 50 as, e.g., the constituents located therein are rapidly heated during thermal processing.

The robustness of the bonds between the components may be particularly important if the device 10 is to be used for thermal cycling processes, e.g., PCR amplification. The repetitive heating and cooling involved in such thermal cycling may pose more severe demands on the bond between the sides of the device 10. Another potential issue addressed by a more robust bond between the components is any difference in the coefficients of thermal expansion of the different materials used to manufacture the components.

The process chambers 50 in the depicted device 10 are in fluid communication with distribution channels 60 that, together with loading chamber 62, provide a distribution system for distributing samples to the process chambers 50. Introduction of samples into the device 10 through the loading chamber 62 may be accomplished by rotating the device 10 about a central axis of rotation such that the sample materials are moved outwardly due to centrifugal forces generated during rotation. Before the device 10 is rotated, the sample can be introduced into the loading chamber 62 for delivery to the process chambers 50 through distribution channels 60. The process chambers 50 and/or distribution channels 60 may include ports through which air can escape and/or other features to assist in distribution of the sample materials to the process chambers 50. Alternatively, sample materials could be loaded into the process chambers 50 under the assistance of vacuum or pressure.

The illustrated device 10 includes a loading chamber 62 with two subchambers 64 that are isolated from each other. As a result, a different sample can be introduced into each subchamber 64 for loading into the process chambers 50 that are in fluid communication with the respective subchamber 64 of the loading chamber 62 through distribution channels 60. It will be understood that the loading chamber 62 may contain only one chamber or that any desired number of subchambers 64, i.e., two or more subchambers 64, could be provided in connection with the device 10.

The body 20 may preferably be polymeric, but may be made of other materials such as glass, silicon, quartz, ceramics, etc. Furthermore, although the body 20 is depicted as a homogenous, one-piece integral body, it may alternatively be provided as a non-homogenous body of, e.g., layers of the same or different materials. For those devices 10 in which the body 20 will be in direct contact with the sample materials, it may be preferred that the material or materials used for the body 20 be non-reactive with the sample materials. Examples of some suitable polymeric materials that could be used for the substrate in many different bioanalytical applications may include, but are not limited to, polycarbonate, polypropylene (e.g., isotactic polypropylene), polyethylene, polyester, etc.

Although the first layer 30 is depicted as a homogenous, one-piece integral layer, it may alternatively be provided as a non-homogenous layer of, e.g., sub-layers of the same or different materials, e.g., polymeric materials, metallic layers, etc.

Also, although the second layer 40 is depicted as a homogenous, one-piece integral layer, it may alternatively be provided as a non-homogenous layer of, e.g., sub-layers of the same or different materials, e.g., polymeric materials, etc. One example of a suitable construction for the second layer 40 may be, e.g., the resealable films described in U.S. Patent Application Publication No. 2003/0118804 A1 filed on Dec.19, 2002 and titled SAMPLE PROCESSING DEVICE WITH RESEALABLE PROCESS CHAMBER and International Publication No. WO 2002/090091 A1 (corresponding to U.S. Patent Application Publication No. 2003/0022010 A1, filed on May 2, 2001), titled CONTROLLED-PUNCTURE FILMS.

It may be preferred that at least a portion of the materials defining the volume of the process chamber 50 be transmissive to electromagnetic energy of selected wavelengths. In the depicted device 10, if the body 20, first layer 30, and/or second layer 40 may be transmissive to electromagnetic energy of selected wavelengths.

In some instances, however, it may be desirable to prevent the transmission of selected wavelengths of electromagnetic energy into the process chambers. For example, it may be preferred to prevent the transmission of electromagnetic energy in the ultraviolet spectrum into the process chamber where that energy may adversely impact any reagents, sample materials, etc. located within the process chamber.

FIG. 2 is an enlarged cross-sectional view of a process chamber 50 in, e.g., the device 10 and FIG. 3 is a cross-sectional view of the process chamber 50 taken along line 3-3 in FIG. 2. As discussed above, the body 20 includes a first major side 22 and a second major side 24. Each of the process chambers 50 is formed, at least in part in this embodiment, by a primary void 70 formed through the body 20. The primary void 70 is formed through the first and second major sides 22 and 24 of the body 20.

The primary void 70 may include features such as a chamfered rim 72 to assist in guiding, e.g., a pipette tip, capillary electrode tip, or other implement into the volume of the process chamber 50 through the second layer 40. The chamfered rim 72 transitions into the main portion of the primary void 70 through a neck 73.

The primary void 70 also includes a sidewall 74. Because the depicted primary void 70 has a circular cylindrical shape, it includes only one sidewall 74. It should be understood, however, that the primary void 70 may take a variety of shapes, e.g., elliptical, oval, hexagonal, octagonal, triangular, square, etc., that may include one or more sidewalls.

A distribution channel 60 enters the process chamber 50 proximate the first major side 22 of the body 20. In the depicted embodiment, the distribution channel 60 is formed into the body 20 with the first layer 30 completing the distribution channel 60. Many other constructions for the distribution channel 60 may be envisioned. For example, the distribution channels may be formed within the first layer 30, with the first major surface 22 of the body 20 remaining substantially flat. Regardless of the precise construction of the distribution channel 60, it is preferred that it enter the process chamber proximate the first major surface 22 of the body 20.

Also seen in FIG. 2 is a bypass slot 80 formed in the sidewall 74 of the primary void 70. The bypass slot 80 extends between the first major side 22 and the second major side 24 of the body 24, although it may not extend over the entire distance between the first and second major sides 22 & 24. The bypass slot 80 does, however, open into the distribution channel 60 proximate the first major side 22 of the body 20 at a location distal from the primary void 70 of the process chamber 50.

The bypass slot 80 may preferably be angled relative to the primary void 70 of the process chamber 50. In one manner, the bypass slot 80 can be characterized as having a cross-sectional area measured in a plane orthogonal to a longitudinal axis 51 of the process chamber 50. When so characterized, the cross-sectional area of the bypass slot 80 may preferably be at a maximum where the bypass slot 80 opens into the distribution channel 60. It may be preferred that bypass slot 80 have a minimum cross-sectional area located distal from the first major side 22 of the body 20.

In another characterization, the bypass slot 80 may have a cross-sectional area (measured in a plane orthogonal to a longitudinal axis 51 of the process chamber 50) that is at a maximum where the bypass slot 80 opens into the distribution channel 60, with the cross-sectional area of the bypass slot 80 decreasing when moving in a direction from the first major side 22 towards the second major side 24 of the body 20.

The bypass slot 80 may be alternatively characterized as having a cross-sectional area (measured in a plane orthogonal to a longitudinal axis 51 of the process chamber 50) that is at a maximum where the bypass slot 80 opens into the distribution channel 60, with the cross-sectional area of the bypass slot 80 smoothly decreasing when moving in a direction from the first major side 20 towards the second major side 24 of the body 20. Although the bypass slot 80 is depicted as decreasing in a linear manner, it should be understood that the profile of the bypass slot 80 may alternatively be a smooth curve, e.g., parabolic, etc.

Figure 4:
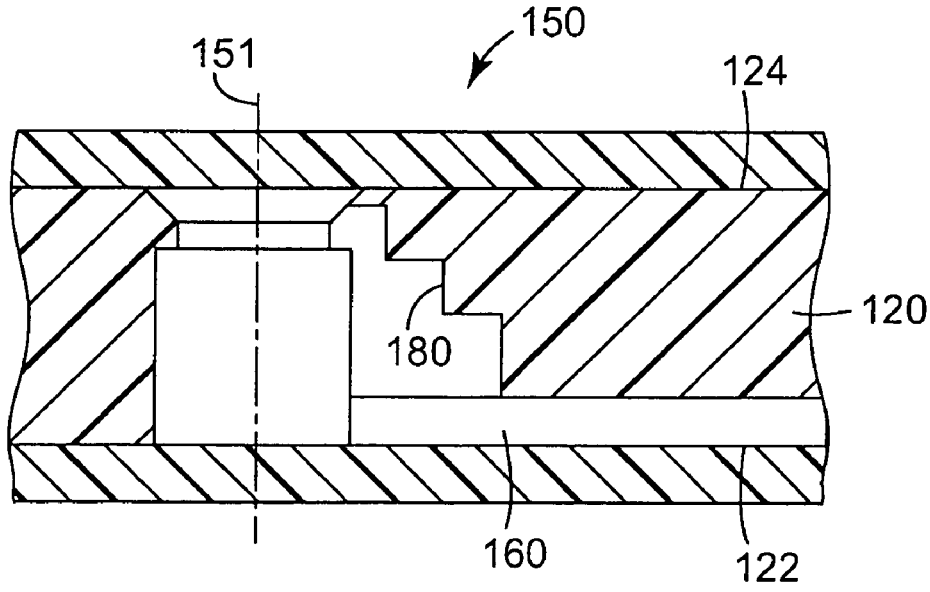
FIG. 4 is an enlarged partial cross-sectional view of an alternative process chamber including a stepped bypass slot.

FIG. 4 depicts another alternative, in which the bypass slot 180 has a cross-sectional area measured in a plane orthogonal to a longitudinal axis 151 of the process chamber 150. The cross-sectional area of the bypass slot 180 is at a maximum where the bypass slot 180 opens into the distribution channel 160, with the cross-sectional area of the bypass slot 180 decreasing in a step-wise manner when moving in a direction from the first major side 122 towards the second major side 124 of the body 120.

Figure 5:
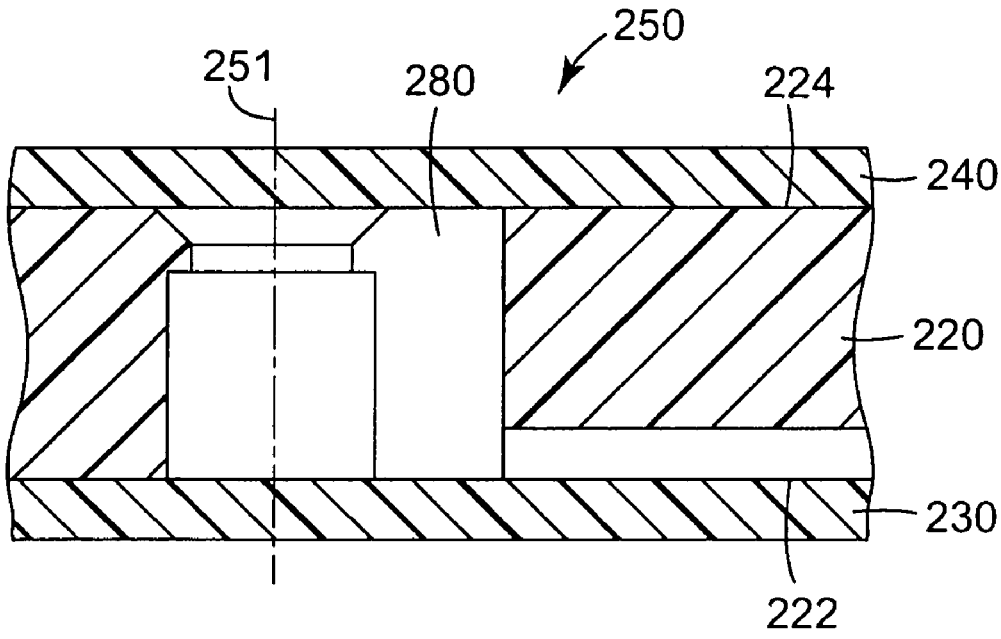
FIG. 5 is an enlarged partial cross-sectional view of a process chamber including a parallel bypass slot.

FIG. 5 depicts another alternative design for a bypass slot 280 in accordance with the present invention. The bypass slot 280 may be described as a parallel bypass slot because its outermost surface, i.e., the surface located distal from the longitudinal axis 251 of the process chamber 250 is essentially parallel to or at least generally aligned with the longitudinal axis 251. As a result, the bypass slot 280 may be characterized as having a cross-sectional area (measured in a plane orthogonal to a longitudinal axis 251 of the process chamber 250) that is substantially constant when moving in a direction from the first major side 222 towards the second major side 224 of the body 220.

Another feature depicted in FIG. 5 is that the bypass slot 280 extends to the second major surface 222 of the body 220 (where it is sealed by the second layer 240. As a result, the bypass slot 280 extends from the distribution channel 260 (which is sealed by first layer 230) to the second major surface 222, essentially forming a "keyhole" shape as seen from above (in connection with the process chamber 250).

Returning to FIGS. 2 & 3, the bypass slot 80 may include a termination point 82 distal from the first major side 22 of the body 20. It may be preferred that the termination point 82 of the bypass slot 80 be spaced from the second major side 24 of the body 20, that is, that the bypass slot 80 terminate before it reaches the second major side 24. In the depicted embodiment, the bypass slot 80 terminates within the area occupied by the chamfered rim 72. As a result, even if the entire neck 73 is occupied by an implement inserted into the process chamber 50, fluid (e.g., air) may escape through the bypass slot 80 (where the bypass slot 80 is formed in the chamfered rim 72).

FIG. 3 depicts other relationships that may be used to characterize the present invention. For example, the bypass slot 80 may preferably have a width that is less than the width of the primary void 70. Furthermore, the bypass slot may preferably have a width that is equal to or less than the width of the distribution channel (as seen in FIG. 3). Although the bypass slot 80 is depicted in FIG. 3 as having a constant width, the width of the bypass slot 80 may vary. For example, the bypass slot may have a width at the distribution channel that substantially matches the width of the distribution channel, but widen or narrow when moving in a direction from the first major side 22 towards the second major side 24 of the body 20.

Although not required, the sample processing devices of the present invention may be used in rotating systems in which the sample processing devices are rotated to effect fluid delivery to the process chambers 50 through the distribution channels 60. In such systems, the primary void 70 and bypass slot 80 of the process chambers 50 of the present invention may preferably be oriented such that the bypass slot 80 is located in the side of the process chamber 50 that is nearest the axis of rotation used during fluid delivery. Typically, the distribution channel 60 will also enter the process chamber 50 from the side nearest the axis of rotation.

In such rotating systems and the sample process devices designed for use in them, it may be preferred that the dimensions of the process chambers, e.g., the diameter of the primary void 70, the width of the bypass slot 80, etc. be selected such that capillary forces, surface tension within the fluid, and/or surface energy of the materials used to construct the process chambers prevent or reduce the likelihood of wetting of the bypass slot 80 by the fluid after loading.

Figure 6:
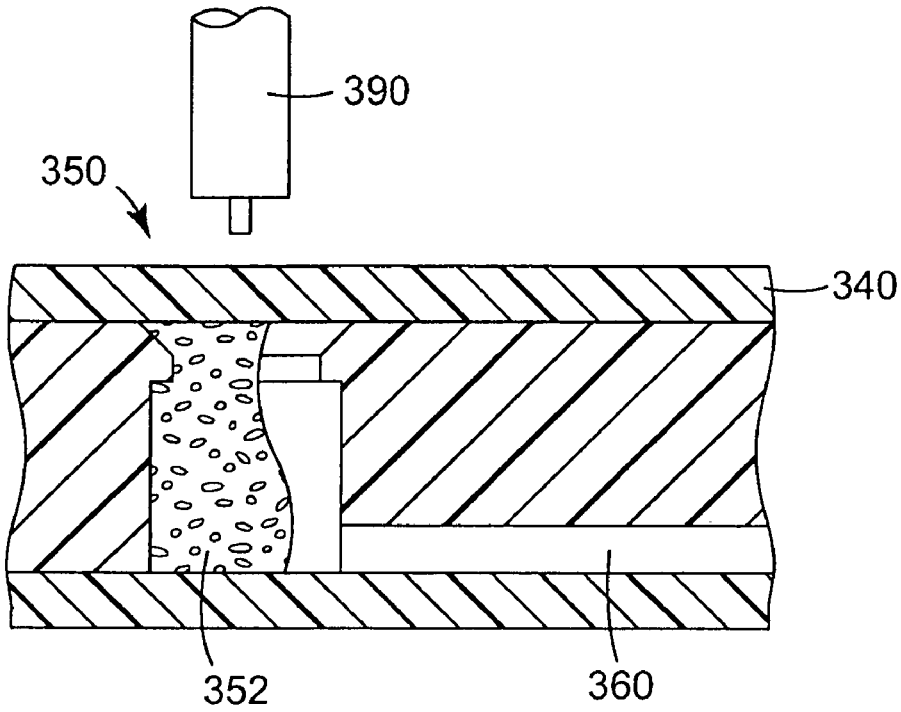
FIG. 6 is an enlarged partial cross-sectional view of a prior art process chamber without a bypass slot.
Figure 7:
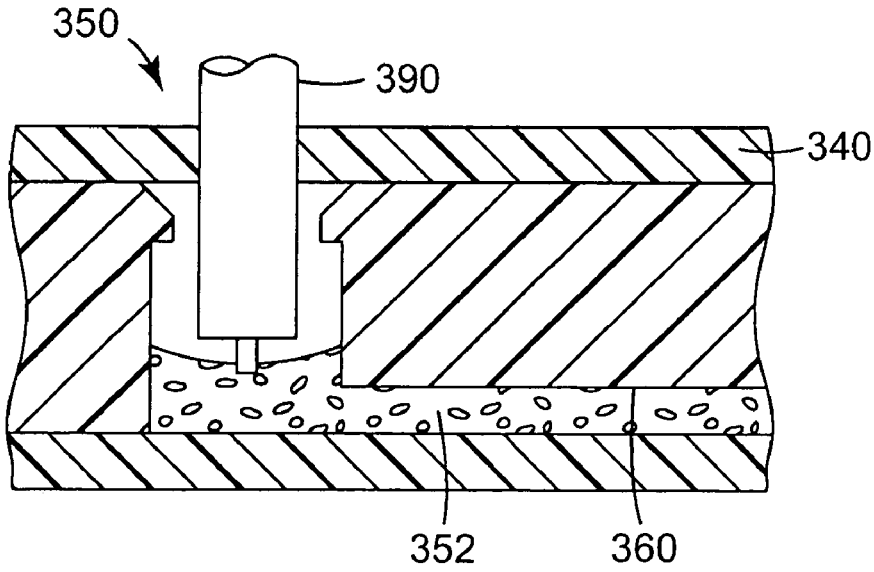
FIG. 7 is an enlarged partial cross-sectional view of the prior art process chamber of FIG. 6 after insertion of an implement into the process chamber.

FIGS. 6 & 7 are provided to illustrate the potential advantages of the present invention. FIG. 6 is a cross-sectional view of a process chamber 350 that does not include a bypass slot as described in connection with the present invention. Fluid 352 has been loaded into the process chamber 350 through distribution channel 360 by centrifugal force. The axis of rotation about which the sample processing device was rotated is located in the direction of arrow 353. The combination of capillary forces generated within the process chamber 350 and surface tension of the fluid 352 may be such that the fluid 352 remains biased away from the axis of rotation. As a result, the fluid 352 is not in contact with nor does it wet out the surface of the process chamber nearest the axis of rotation.

Also seen in FIG. 6 is an implement 390 poised for insertion into the volume of the process chamber 350. The implement 390 may be, e.g., a capillary electrode used to perform electrophoresis on the materials within fluid 352. In many instances, the relative dimensions of the implement 390 and the process chamber 350 may produce a piston effect that forces the fluid 352 back into the distribution channel 360 as the implement 390 is introduced into the process chamber 350. Because the amount of fluid 352 within the process chamber is relatively small, any such loss of fluid 352 may negatively impact analysis of the sample materials in the fluid 352.

FIG. 7 is a cross-sectional view of the process chamber 350 after insertion of the implement 390 into the fluid 352. Experiments conducted by the inventors have demonstrated that in the absence of a bypass slot, the fluid 352 is, in fact, forced back into the distribution channel 360 upon insertion of an implement 390 into the process chamber 350.

Figure 8:
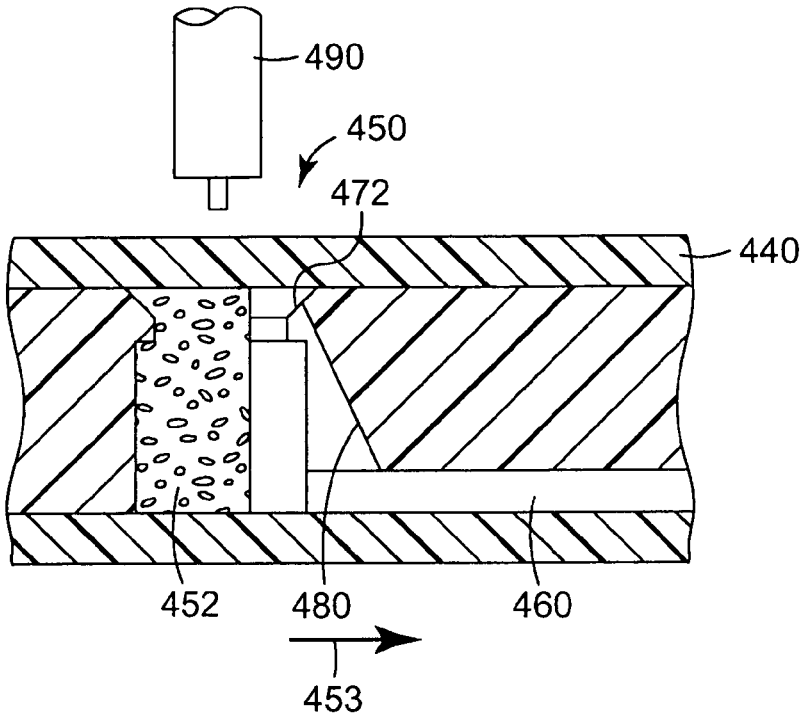
FIG. 8 is an enlarged partial cross-sectional view of a process chamber including a bypass slot in accordance with the present invention (with fluid sample material located in the process chamber).

FIG. 8 is a cross-sectional view of a process chamber 450 including a bypass slot 480 in accordance with the present invention in which a fluid 452 has been loaded through distribution channel 460 by centrifugal force. The axis of rotation about which the sample processing device was rotated is located in the direction of arrow 453. It may be preferred that, as depicted, the combination of capillary forces generated within the process chamber 450 and surface tension of the fluid 452 be such that the fluid 452 remains biased away from the axis of rotation. As a result, the fluid 452 is not in contact with, nor does it wet out, the bypass slot 480 that is located proximate the axis of rotation.

Some examples of potentially suitable dimensions for the process chamber 450 are, e.g., a process chamber diameter of 1.7 millimeters and height of 3 millimeters. The distribution channel feeding such a process chamber may have a width of 0.64 millimeters and a depth of 0.38 millimeters. Where the by pass slot has a width equal to the width of the distribution channel (i.e., 0.64 millimeters) and is angled such as is depicted in FIG. 8, the junction of the bypass slot and the distribution channel may be located 0.4 millimeters from the sidewall of the process chamber.

Also seen in FIG. 8 is an implement 490 poised for insertion into the volume of the process chamber 450. The implement 490 may be, e.g., a pipette tip, needle, capillary electrode, etc. In one exemplary method, the implement 490 may be, e.g., a capillary electrode used to perform electrophoresis on the materials within fluid 452. As discussed above, one concern due to the relative dimensions of the implement 490 and the process chamber 450 is the piston effect that may result in movement of the fluid 452 back into the distribution channel 460 as the implement 490 is introduced into the process chamber 450. Again, because the amount of fluid 452 within the process chamber 450 is relatively small, any such loss of fluid 452 may negatively impact analysis of the sample materials in the fluid 452.

Figure 9:
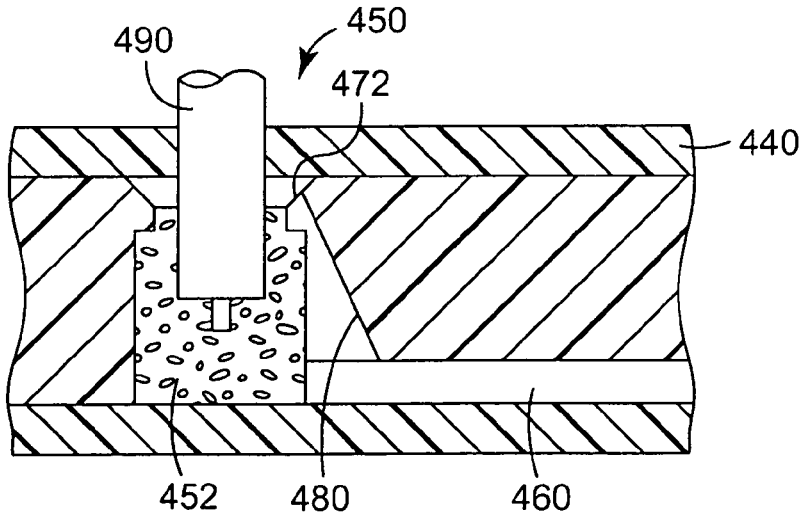
FIG. 9 is an enlarged partial cross-sectional view of the process chamber of FIG. 8 after insertion of an implement into the process chamber.

FIG. 9 is a cross-sectional view of the process chamber 450 after insertion of the implement 490 into the fluid 452. Insertion of the implement 490 involves (in the illustrated method) piercing the layer 440 of the process chamber 450. The bypass slot 480, as depicted, may alleviate the piston effect that could otherwise occur upon insertion of the implement 490 into the process chamber 450 by, e.g., providing a fluid path for escape of the air contained within the process chamber 450 before introduction of the implement 490. The bypass slot 480 may allow the trapped air to escape through the chamfered rim 472 and/or the distribution channel 460. By extending the bypass slot 480 into the chamfered rim 472, pressure within the process chamber 450 as the second layer 440 deflects downward during insertion of the implement 490 may be relieved without significantly distorting the surface of the fluid 452.

The complete disclosures of the patents, patent documents, and publications cited herein are incorporated by reference in their entirety as if each were individually incorporated. Various modifications and alterations to this invention will become apparent to those skilled in the art without departing from the scope and spirit of this invention. It should be understood that this invention is not intended to be unduly limited by the illustrative embodiments set forth herein and that such embodiments are presented by way of example only, with the scope of the invention intended to be limited only by the claims.

The invention claimed is:

1. A sample processing device comprising:

a body comprising a first major side and an opposing second major side;

a plurality of process chambers located within the body, each of the process chambers comprising a primary void extending between the first major side and the second major side of the body;

a distribution channel entering each process chamber of the plurality of process chambers, wherein the distribution channel enters the process chamber proximate the first major side of the body; and a bypass slot formed in a sidewall of each of the process chambers, the bypass slot extending between the first major side and the second major side of the body, wherein the bypass slot opens into the distribution channel proximate the first major side of the body at a location distal from the primary void of the process chamber.

2. A sample processing device according to claim 1, wherein the bypass slot comprises a cross-sectional area measured in a plane orthogonal to a longitudinal axis of the process chamber, and wherein the cross-sectional area of the bypass slot is at a maximum where the bypass slot opens into the distribution channel.

3. A sample processing device according to claim 1, wherein the bypass slot comprises a cross-sectional area measured in a plane orthogonal to a longitudinal axis of the process chamber, and wherein the cross-sectional area of the bypass slot is at a maximum where the bypass slot opens into the distribution channel, and further wherein a minimum cross-sectional area of the bypass slot is located distal from the first major side of the body.

4. A sample processing device according to claim 1, wherein the bypass slot comprises a cross-sectional area measured in a plane orthogonal to a longitudinal axis of the process chamber, and wherein the cross-sectional area of the bypass slot is at a maximum where the bypass slot opens into the distribution channel, with the cross-sectional area of the bypass slot decreasing when moving in a direction from the first major side towards the second major side of the body.

5. A sample processing device according to claim 1, wherein the bypass slot comprises a cross-sectional area measured in a plane orthogonal to a longitudinal axis of the process chamber, and wherein the cross-sectional area of the bypass slot is at a maximum where the bypass slot opens into the distribution channel, with the cross-sectional area of the bypass slot smoothly decreasing when moving in a direction from the first major side towards the second major side of the body.

6. A sample processing device according to claim 1, wherein the bypass slot comprises a cross-sectional area measured in a plane orthogonal to a longitudinal axis of the process chamber, and wherein the cross-sectional area of the bypass slot is at a maximum where the bypass slot opens into the distribution channel, with the cross-sectional area of the bypass slot decreasing in a step-wise manner when moving in a direction from the first major side towards the second major side of the body.

7. A sample processing device according to claim 1, wherein the cross-sectional area of the bypass slot is constant when moving between the first major side and the second major side of the body.

8. A sample processing device according to claim 1, wherein the bypass slot comprises a termination point distal from the first major side of the body, and further wherein the termination point of the bypass slot is spaced from the second major side of the body.

9. A sample processing device according to claim 1, wherein the bypass slot extends to the second major side of the body.

10. A sample processing device according to claim 1, wherein the primary void of the process chamber comprises a circular cylindrical void.

11. A sample processing device comprising:

a body comprising a first major side and an opposing second major side;

a plurality of process chambers located within the body, each of the process chambers comprising a primary void extending between the first major side and the second major side of the body;

a distribution channel entering each process chamber of the plurality of process chambers, wherein the distribution channel enters the process chamber proximate the first major side of the body; and a bypass slot formed in a sidewall of each of the process chambers, the bypass slot extending between the first major side and the second major side of the body, wherein the bypass slot opens into the distribution channel proximate the first major side of the body at a location distal from the primary void of the process chamber;

wherein the bypass slot comprises a cross-sectional area measured in a plane orthogonal to a longitudinal axis of the process chamber, and wherein the cross-sectional area of the bypass slot is at a maximum where the bypass slot opens into the distribution channel, and wherein the bypass slot comprises a termination point distal from the first major side of the body, and further wherein the termination point of the bypass slot is spaced from the second major side of the body.

12. A sample processing device according to claim 11, wherein the cross-sectional area of the bypass slot smoothly decreases when moving in a direction from the first major side towards the second major side of the body.

13. A sample processing device according to claim 11, wherein the cross-sectional area of the bypass slot decreases in a step-wise manner when moving in a direction from the first major side towards the second major side of the body.

14. A sample processing device according to claim 11, wherein the primary void of the process chamber comprises a circular cylindrical void.

15. A method of processing sample materials located within a process chamber, the method comprising:

providing a sample processing device according to claim 1;

loading fluid sample material into at least one process chamber of the plurality of process chambers in the sample processing device; and inserting an implement into the at least one process chamber loaded with fluid sample material.

16. A method according to claim 15, wherein the implement pierces a layer of the at least one process chamber during the inserting.

17. A method according to claim 15, wherein the implement comprises a capillary electrode, and wherein the method further comprises performing capillary electrophoresis on the fluid sample material located in the at least one process chamber.

18. A method of processing sample materials located within a process chamber, the method comprising:

providing a sample processing device according to claim 11;

loading fluid sample material into at least one process chamber of the plurality of process chambers in the sample processing device; and inserting an implement into the at least one process chamber loaded with fluid sample material.

19. A method according to claim 18, wherein the implement pierces a layer of the at least one process chamber during the inserting.

20. A method according to claim 18, wherein the implement comprises a capillary electrode, and wherein the method further comprises performing capillary electrophoresis on the fluid sample material located in the at least one process chamber.

* * * * *

UNITED STATES PATENT AND TRADEMARK OFFICE

CERTIFICATE OF CORRECTION

PATENT NO. : 7,332,129 B2
APPLICATION NO. : 10/339447
DATED : February 19, 2008
INVENTOR(S) : Barry W. Robole It is certified that error appears in the above-identified patent and that said Letters Patent is hereby corrected as shown below:

Column 3
Line 27, Delete "METHODS;" and insert -- METHODS (Attorney Docket No. 55265USA19.003); --, therefore.
Line 30, Delete "METHODS;" and insert -- METHODS (Attorney Docket No. 55265USA99.003); --, therefore.
Line 32, Delete "METHODS;" and insert -- METHODS (Attorney Docket No. 56047USA29); --, therefore.
Line 36, After "METHODS" insert -- . --.
Line 36, Delete "maybe" and insert -- may be --, therefore. (Consider Space)
Line 40, Delete "6,2001" and insert -- 6, 2001 --, therefore. (Consider Space)
Line 41, Delete "PROCESSIING" and insert -- PROCESSING --, therefore.
Line 42, Delete "METHODS ," and insert -- METHODS (Attorney Docket No. 56284USA19.002), --, therefore.
Line 51, Delete "US2003/0118804 A1 ," and insert -- US 2003/0118804 A1, --, therefore.

Column 5
Line 43, Delete "Dec.19," and insert -- Dec. 19, --, therefore. (Consider Space)

Signed and Sealed this

First Day of July, 2008

JON W. DUDAS
*Director of the United States Patent and Trademark Office*